US006879233B2

(12) United States Patent
Yen

(10) Patent No.: US 6,879,233 B2
(45) Date of Patent: Apr. 12, 2005

(54) INDUCTOR INDUCED LIGHT EMITTING BOTTLE

(76) Inventor: Yen Jen Yen, 235 Chung-Ho Box 8-24, Taipei (TW)

( * ) Notice: Subject to any disclaimer, the term of this patent is extended or adjusted under 35 U.S.C. 154(b) by 328 days.

(21) Appl. No.: 10/437,610

(22) Filed: May 15, 2003

(65) Prior Publication Data

US 2004/0227607 A1 Nov. 18, 2004

(51) Int. Cl.[7] ..... H01F 21/12
(52) U.S. Cl. ..... 336/145
(58) Field of Search ..... 336/145, 136, 336/DIG. 2, 110, 107

(56) References Cited

U.S. PATENT DOCUMENTS 4,010,536 A * 3/1977 Fujita et al. ..... 29/593
6,028,501 A * 2/2000 Okamoto et al. ..... 336/110
6,127,800 A * 10/2000 Kuki et al. ..... 320/108
6,561,022 B1 * 5/2003 Doyle et al. ..... 73/313

* cited by examiner

*Primary Examiner*—Chau Nguyen

(57) ABSTRACT

An inductor induced light emitting bottle comprises a seat having a transformer therein; the transformer being connected to a power source for voltage reduction. A transparent bottle serves for receiving water. A first coil is made of copper wire. The first coil encloses a periphery of the transparent bottle. One end of the first coil passes through the though hole to be connected to a lower voltage output end of the transformer. A light emitting unit has a hollow transparent casing, a second coil, a LED lamp, a sealing cover. A diameter of the second coil is smaller than that of the first coil. The LED lamp is connected to two ends of the second coil. The light emitting unit is disposed in the transparent bottle so that the second coil of the light emitting unit is disposed in the first coil as a transformer when they are conducted.

3 Claims, 5 Drawing Sheets

INDUCTOR INDUCED LIGHT EMITTING BOTTLE

FIELD OF THE INVENTION

The present invention relates to light emitting bottle, and particularly to an inductor induced light emitting bottle, in that bulb can be placed in water so as to present many beautiful sceneries to users.

BACKGROUND OF THE INVENTION

In the prior art light emitting bottle, a plurality of smaller bulbs are added on the seat or a periphery of the bottle and then the bulbs are connected to a power switch and a power source so as light up the bulbs. The prior art has the following disadvantages. The bulbs are tungsten silks. As a result, power consumption is larger. Moreover, the silks are directly connected to a power source so that problem of insulation induced. Especially, when it is placed in water. Power loss often occurs due to bad insulation. Thereby, the bulbs are disposed out of bottles instead of within the bottle. As a result, many beautiful effects by mixing the light effect and water effect cannot be presented to viewers. Furthermore, the bulbs are fixedly installed to power sources. Thereby, the bulbs cannot be detached. The tungsten bulbs emit yellow light, and thus other lights can not be presented.

SUMMARY THE INVENTION

Accordingly, the primary object of the present invention is to provide an inductor induced light emitting bottle which comprises a seat having a transformer therein; the transformer being connected to a power source for voltage reduction. A transparent bottle serves for receiving water. A first coil is made of copper wire. The first coil encloses a periphery of the transparent bottle. One end of the first coil passes through the though hole to be connected to a lower voltage output end of the transformer. A light emitting unit has a hollow transparent casing, a second coil, a LED lamp, a sealing cover. A diameter of the second coil is smaller than that of the first coil. The LED, lamp is connected to two ends of the second coil. The light emitting unit is disposed in the transparent bottle so that the second coil of the light emitting unit is disposed in the first coil as a transformer when they are conducted.

The various objects and advantages of the present invention will be more readily understood from the following detailed description when read in conjunction with the appended drawing.

DETAILED DESCRIPTION OF THE PREFERRED EMBODIMENTS

Figure 1:
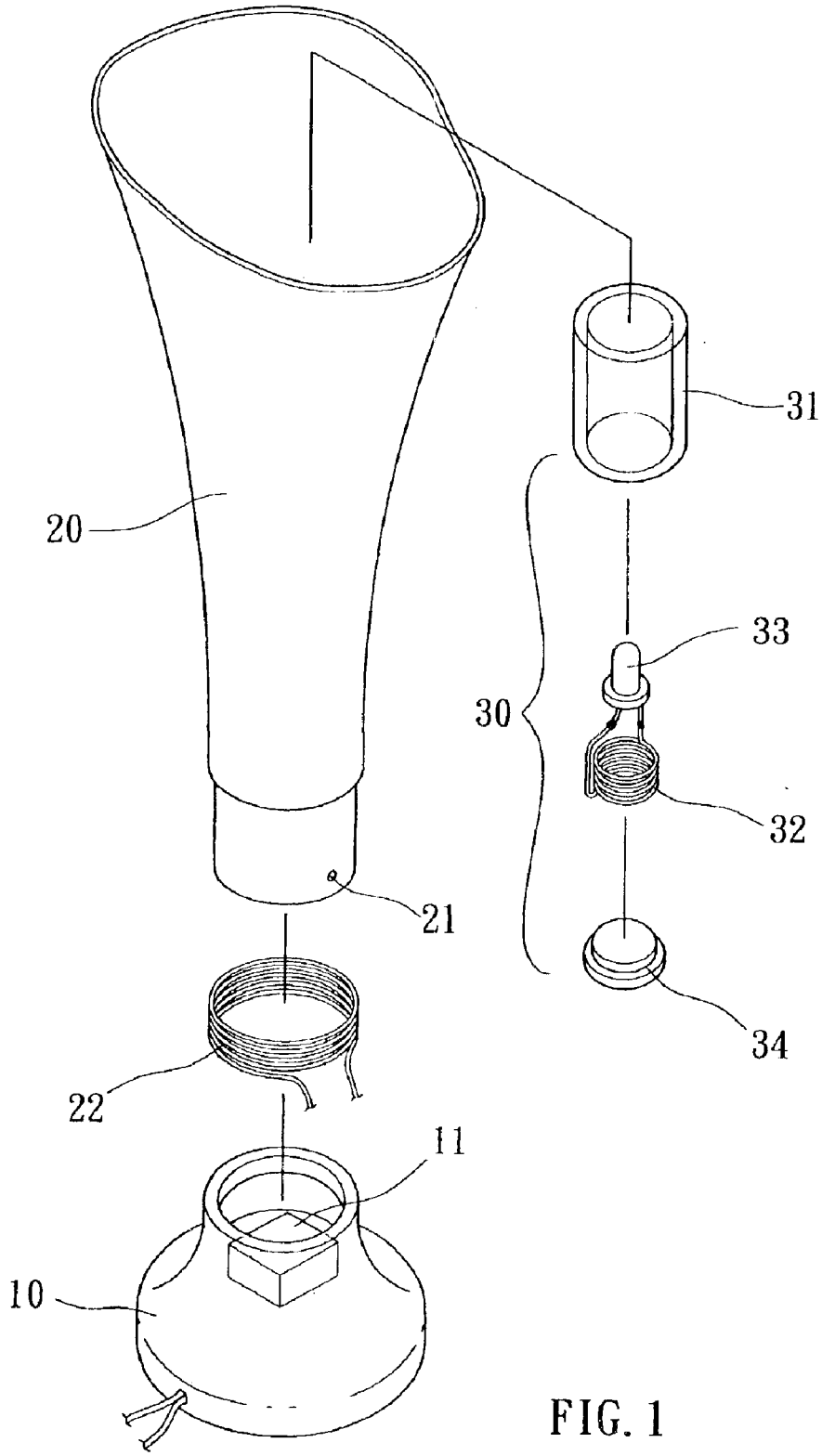
FIG. 1 is the exploded perspective view of the preferred embodiment of the present invention.
Figure 2:
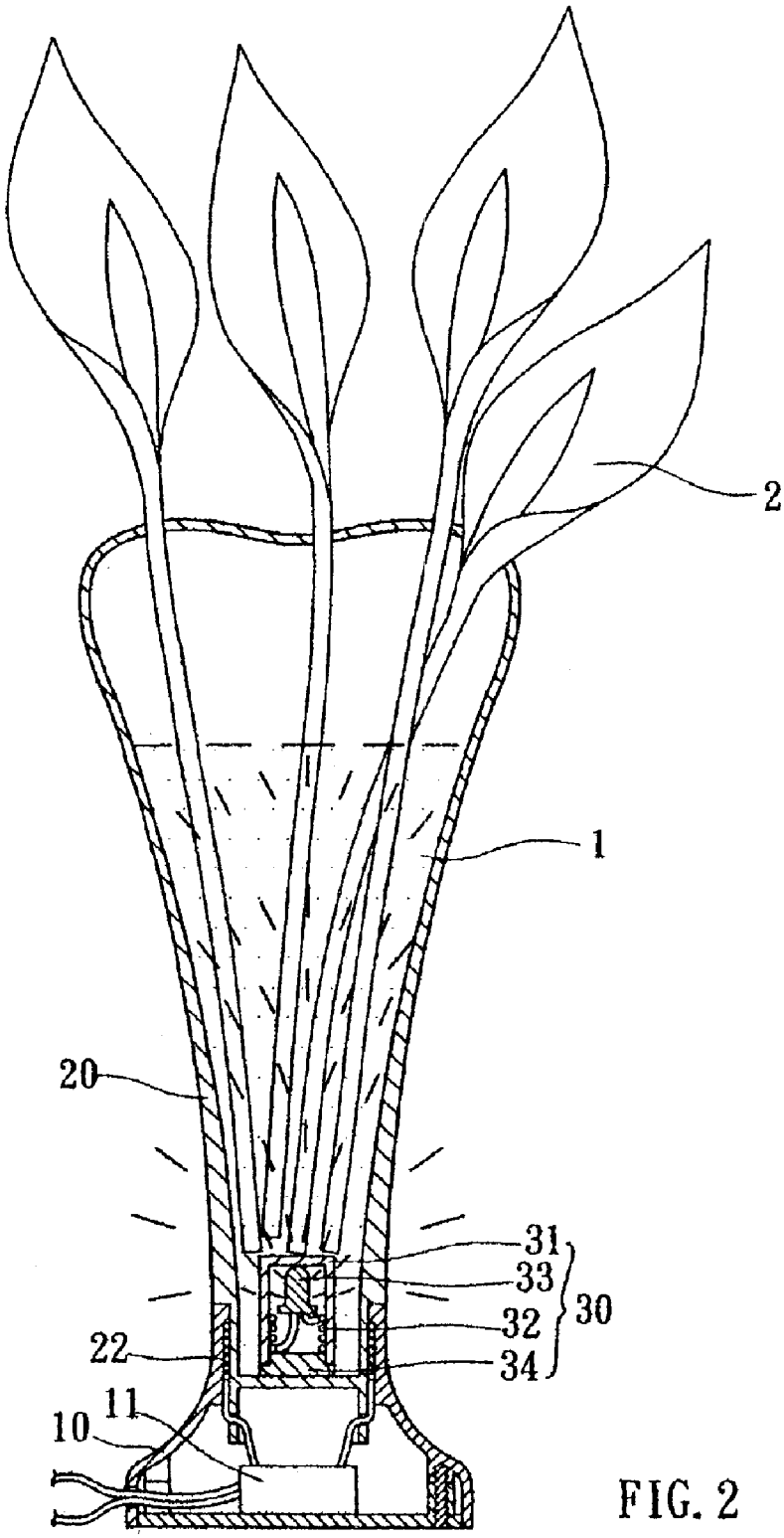
FIG. 2 is a schematic view showing the assemble and use of the structure in FIG. 1.
Figure 3:
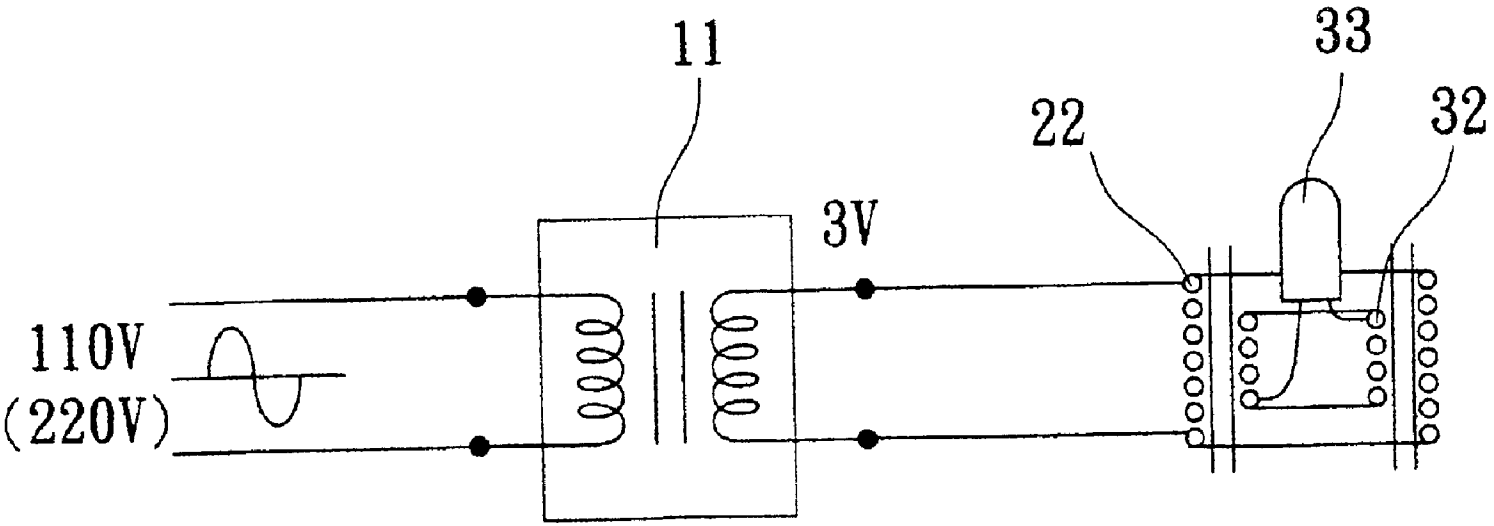
FIG. 3 shows the wire layout of the present invention.

Referring to FIGS. 1, 2 and 3, the inductor induced light emitting bottle according to the present invention is illustrated. The inductor induced light emitting bottle includes a seat 10, a transparent bottle 20,a first coil 22, a light emitting unit 30.

The seat 10 has a transformer 11 therein. The transformer 11 is connected to a power source for reducing a voltage of the power source to match the requirement of LED lamp 33, for example, 3V.

The transparent bottle 20 serves for receiving water 1, and a lower side of the transparent bottle 20 has a though hole, 21. The lower side of the transparent bottle 20 is combined to the seat 10.

The first coil 22 is made of copper wires. The first coil 22 encloses a periphery of the transparent bottle 20. One end of the first coil 22 passes through the though hole 21 to be connected to a low voltage output end of the transformer 11.

The light emitting unit 30 has a hollow transparent casing 31, a second coil 32, a LED lamp 33, a sealing cover 34. A diameter of the second coil 32 is smaller than that of the first coil 22. The LED lamp 33 is connected to two ends of the second coil 32 and then is disposed in the transparent casing 31. Then the transparent casing 31 is sealed by the sealing cover 34 so as to be in water-tightness condition. Moreover, the light emitting unit 30 can be disposed in the transparent bottle 20 so that the second coil 32 of the light emitting unit 30 is disposed in the first coil 22. That is, the second coil 32 is enclosed by the first coil 22.

By above mentioned structure, when power is on, the first coil 22 will interact with the second coil 32 so as to generate an electromotive force to make the LED lamp 33 lights up. Thus, the light emitting unit 30 can light up without needing to be wired-connected to the power source.

Referring to FIG. 2, water 1 is filled into the transparent bottle 20 of the present invention and then flower 2 is placed in the bottle. The light emitting unit 30 is disposed at the bottom of the transparent bottle 20. When power is on, the transformer 11 provides a low voltages for example 3V, to the first coil 22. Then the first, coil 22 generates an electromotive force. Since the second coil 32 is placed in the first coil 22, the second coil 32 also induces with an electromotive force so as to light up the LED lamp 33. Thereby, the arrangement of the first coil 22 and second coil 32 is like a transformer.

Advantages of the present invention will be described herein.

The light emitting unit 30 is made of LED lamp 33 with low power consumption. It is not directly connected to the power source, but is placed in water. The light emitting unit 30 can be taken away when it does not light up.

The light emitting unit 30 is placed in water and lights up so as to present a beautiful scenery due to the light effect in water.

A variety of LEDs can be used in the LED lamp 33 so at to present different sceneries to the viewers.

The voltage of power source of the light emitting unit 30 is as low as 3V, so as not to harm anybody. Thereby, the casing is water-tightly and thus the whole structure is in a safety condition.

Figure 4:
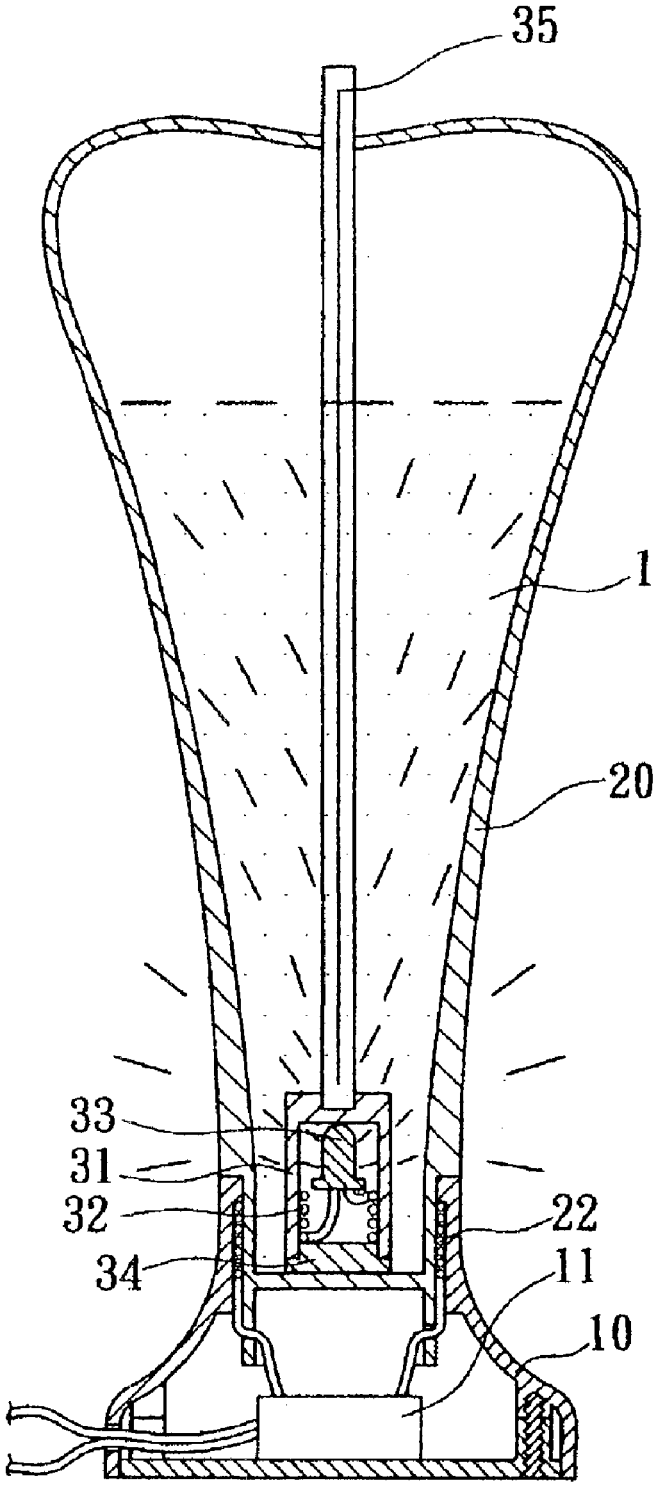
FIG. 4 shows the cross section view of the embodiment of the present invention, where a light guide bar is added.
Figure 5:
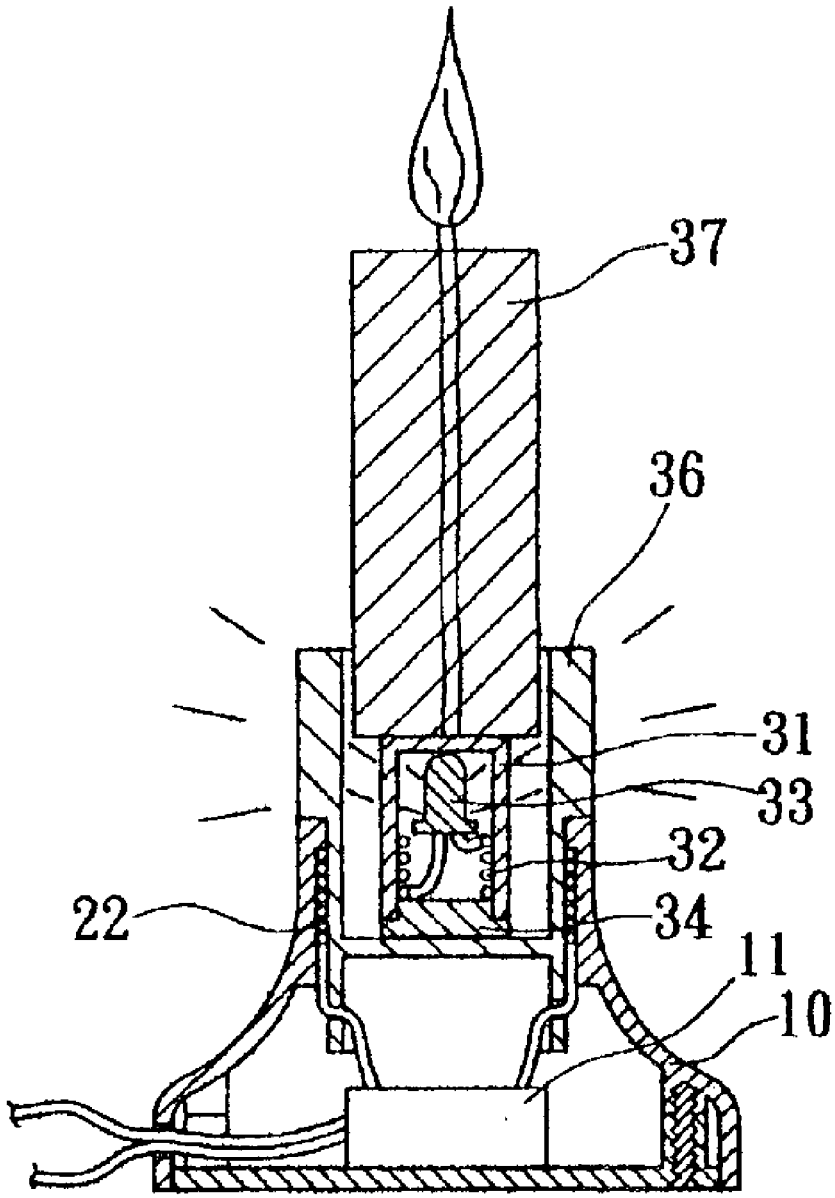
FIG. 5 is a cross section view about the embodiment of the candle base of the present invention.

Referring to FIGS. 4 and 5, other embodiment of the present invention is presented.

In FIG. 4, a transparent light guide bar 35 is firmly secured to the transparent casing 31 of the light emitting unit 30 so that the light from the LED lamp 33 is guided to the light guide bar 35 as a lighting bar. Thereby, a beautiful outlook is presented.

In FIG. 5, the transparent bottle 20 is changed as a candle base 36 for disposing, a candle. The first, soil 22 is disposed at a lower periphery of the candle base 36. LED lamp 33 and the light emitting unit 30 of the second coil 32 are disposed in the candle base 36 so that the candle base 36 presents a beautiful light effect.

The present invention is thus described, it will be obvious that the same may be varied in many ways. Such variations are not to be regarded as a departure from the spirit and scope of the present inventions and all such modifications as would be obvious to one skilled in the art are intended to be included within the scope of the following claims.

What is claimed is:

1. An inductor induced light emitting bottle comprising:

a seat having a transformer therein; the transformer being connected to a power source for reducing a voltage of the power source to match the requirement of LED lamp;

a transparent bottle for receiving water, and a lower side of the transparent bottle having a though hole; a lower side of the transparent bottle being combined to the seat;

a first coil being made of copper wire; the first coil enclosing a periphery of the transparent bottled; one end of the first coil passing through the though hole to be connected to a lower voltage output end of the transformer; and a light emitting unit having, a hollow transparent casing, a second coil, a LED lamp, a sealing cover; a diameter of the second coil being smaller than that of the first coil; the LED lamp being connected to two ends of the second coil and then being disposed in the transparent casing; then the transparent casing being sealed by the sealing cover so as to be in water-tightness condition; moreover, light emitting unit being disposed in the transparent bottle so that the second coil of the light emitting unit being disposed in the first coil; that is, the second coil being enclosed by the first coil;

wherein by above mentioned structure, when power is on, the first coil interacts with the second coil so as to generate an electromotive force to make the LED lamp lights up; thus, the light emitting unit lights up without needing to be connected to the power source.

2. The inductor induced light emitting bottle with a seat as claimed in claim 1, wherein a transparent light guide bar is firmly secured to the transparent casing of the light emitting unit so that the light from the LED lamp is guided to the light guide bar as a lighting bar.

3. The inductor induced light emitting bottle with a seat as claimed in claim 1, wherein the transparent bottle has a shape of candle base for disposing a candle therein; the first coil is disposed at a lower periphery of the candle base; the LED lamp and the light emitting unit of the second coil are disposed in the candle base so that the candle base presents a beautiful light effect.

* * * * *